United States Patent [19]

Billberg et al.

[11] Patent Number: 4,779,781

[45] Date of Patent: Oct. 25, 1988

[54] METHOD AND AN ARRANGEMENT FOR THE FEEDING OF A MATERIAL WEB

[75] Inventors: Alf Billberg, Oxie; Göte L. Bernle, Malmö, both of Sweden

[73] Assignee: AB Tetra Pak, Lund, Sweden

[21] Appl. No.: 936,232

[22] Filed: Dec. 1, 1986

Related U.S. Application Data

[63] Continuation-in-part of Ser. No. 821,510, Jan. 22, 1986, Pat. No. 4,625,902, which is a continuation of Ser. No. 575,765, Feb. 1, 1984, abandoned.

[30] Foreign Application Priority Data

Feb. 10, 1983 [SE] Sweden ..... 8300706

[51] Int. Cl.[4] ..... B65H 23/04; B65H 20/04; B26D 5/22; B23D 25/12

[52] U.S. Cl. ..... 226/2; 83/26; 83/260; 83/346; 226/86; 226/115; 226/143; 226/153

[58] Field of Search ..... 226/58, 76, 86, 115, 226/143, 2, 153, 154; 83/26, 235, 260, 268, 278, 343, 346, 674, 261, 259, 23, 13

[56] References Cited

U.S. PATENT DOCUMENTS

| | | | |
|---|---|---|---|
| 560,839 | 5/1896 | Cohen | 83/278 X |
| 734,215 | 7/1903 | Bilgram | 83/268 |
| 1,791,144 | 2/1931 | Ranney et al. | 226/153 X |
| 1,859,962 | 5/1932 | Ferenci | 83/268 |
| 2,358,411 | 9/1944 | May | 226/169 |
| 2,678,748 | 5/1954 | McCain et al. | 83/26 X |
| 2,796,930 | 6/1957 | Bennett | 83/156 |
| 2,946,281 | 7/1960 | Sohn | 226/153 X |
| 3,021,988 | 2/1962 | Focht | 226/58 |
| 3,058,641 | 10/1962 | Peterson | 226/153 X |
| 3,325,335 | 6/1967 | Martensson | 83/346 X |
| 3,531,591 | 9/1970 | Jarmy | 226/76 X |
| 3,724,734 | 4/1973 | Sachtleben et al. | 226/154 X |
| 3,726,455 | 4/1973 | Sandbach | 226/87 X |
| 3,767,098 | 10/1973 | Pabodie | 226/168 X |
| 3,972,460 | 8/1976 | Kesinger et al. | 226/85 X |
| 3,977,586 | 8/1976 | Hertrich | 226/143 X |
| 4,364,504 | 12/1982 | Meyers | 226/76 |

FOREIGN PATENT DOCUMENTS

| | | |
|---|---|---|
| 520207 | 6/1955 | Belgium . |
| 0013968 | 8/1980 | European Pat. Off. . |
| 300011 | 5/1971 | U.S.S.R. . |

*Primary Examiner*—Harvey C. Hornsby
*Assistant Examiner*—Scott J. Haugland
*Attorney, Agent, or Firm*—Burns, Doane, Swecker & Mathis

[57] ABSTRACT

A method and arrangement for severing packaging blanks, including a drive roller, a register roller at a location downstream of the drive roller and high-speed driving rollers downstream of the register roller for removing severed web portions. The drive roller is provided with a circumferential web-engaging surface and a knife located in a circumferential gap in the web-engaging surface. The drive roller cooperates with a counter roller, and a pendulum roller is located upstream of drive roller.

13 Claims, 2 Drawing Sheets

Fig. 1
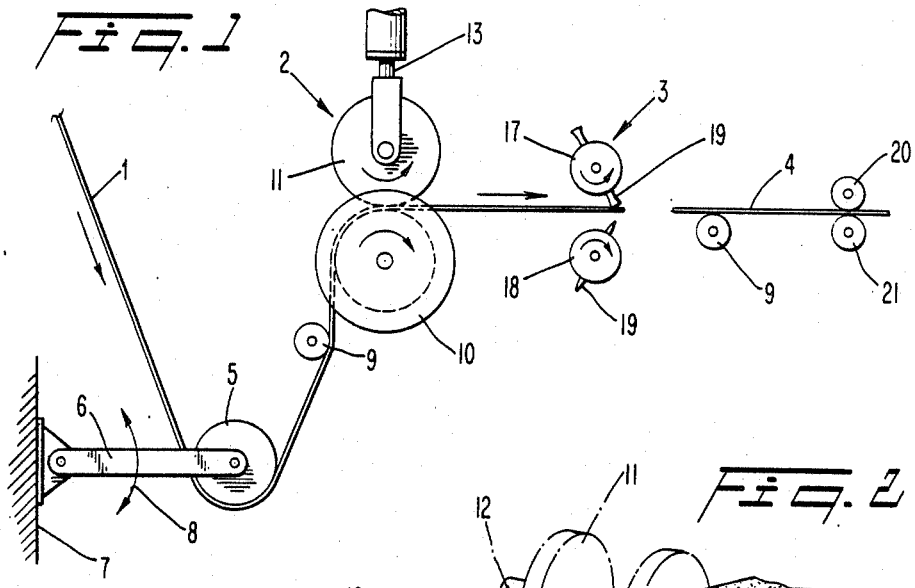
Fig. 2
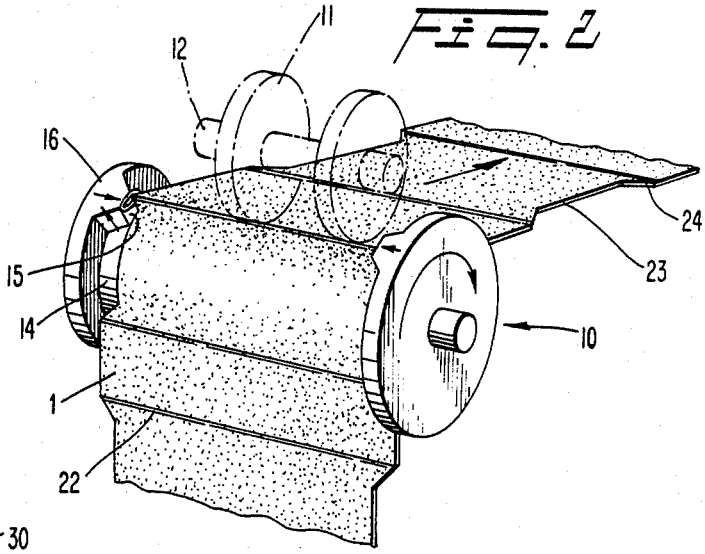
Fig. 3
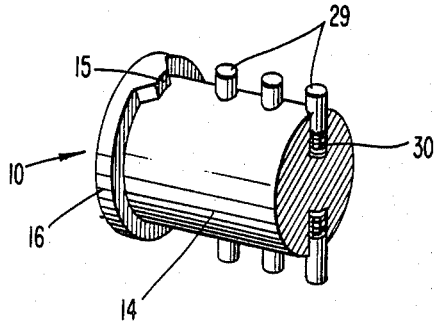
Fig. 4
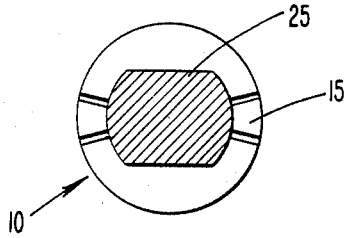
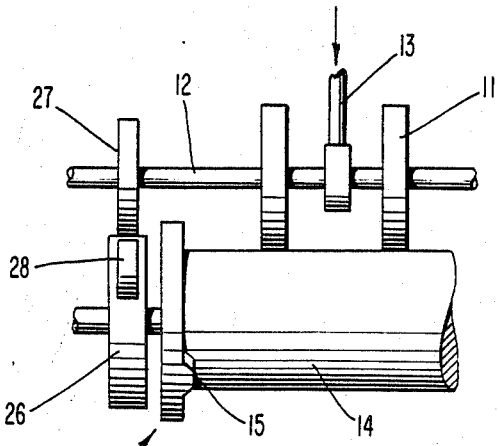
Fig. 5

METHOD AND AN ARRANGEMENT FOR THE FEEDING OF A MATERIAL WEB

This application is a continuation-in-part of application Ser. No. 821,510 filed Jan. 22, 1986, now U.S. Pat. No. 4,625,902, which is a continuation of Ser. No. 575,765 filed Feb. 1, 1984, now abandoned.

FIELD OF INVENTION

The present invention relates to a method for the feeding of a patterned material web for processing in register with the pattern of the material web, this method comprising a stepwise feeding of the material web and a register correction performed prior to each processing operation.

The invention also relates to an arrangement for the realization of the method, this arrangement comprising a feeding unit for the material web.

DISCUSSION OF THE PRIOR ART

The processing of moving material webs occurs frequently in different sections of industry and comprises varying types of processing, e.g., printing, punching or cutting of a multitude of different materials such as metal, plastics, paper or combinations thereof. In the packaging industry, web-like laminated material is often used which comprises different layers of, for example, plastics and paper for the manufacture of individual packing containers for various types of contents such as milk, juice or the like. Prior to conversion to individual packing containers, the laminated material is processed while it is still in the form of a web and is provided with such features as emptying openings, cover strips, crease lines or printed marks. Moreover, the moving material is often divided into individual packing container blanks, these blanks being fed subsequently into the packaging machine proper to be converted to packing containers and filled with contents. The different processing operations usually have to be done in register with earlier processing stages, and it is also customary for the web to have been provided with a geometrical pattern of, for example, crease lines or a printed decorative pattern, before the processing operations. In this context it is of course of the greatest importance that the processing operations are carried out in register with the said pattern so that the pattern will be in correct position on the finished packing container.

The above mentioned requirement of keeping a moving packing material web in register during processing can be met by a multitude of different methods. According to a frequently used method the feed is carried out in steps in rhythm with the processing units in that each step is introduced by a first feeding in which the material web is advanced over a distance which substantially corresponds to the pattern division of the material web. Then a correction of the position of the material web takes place before the processing operation. During the correction the web is displaced over a comparatively short distance until the detector devices, e.g., photocells, crease line finders or the like, transmit signals to a feeding device that the web is in correct position for the processing operation. Thereupon, the processing is carried out and the first feeding is resumed so that the material web is advanced a step further for the next processing operation. The feeding of the material web takes place in this known method with the help of cooperating cylinders and for the correction movement separate detector and position adjustment devices are used. The method operates satisfactorily but is fairly slow, since the first feed has to be stopped completely before the position correction can be made. The distance between the different devices which advance the material web and detect and control its position moreover has the effect that elongation and stretching of the material web occur which have a negative effect on accuracy. Finally, the relatively great number of cooperating units makes the design complicated and increases the risk of operational failures.

The difficulties in the feeding of a material web in register with the pattern of the web is particularly great in those cases where the subsequent processing involves the dividing up of the material web into individual packing material blanks by cutting, since the cutting off process means that the web can no longer be pulled forward through the register-keeping unit with the help of a driving element arranged after the same. Instead, the web has to be fed to the processing unit with the help of a feeding unit which precedes the processing unit. In a rational manufacturing process the feeding has to take place at great speed and with high demands of accuracy insofar as the keeping in register is concerned and no method or arrangement has been put forward up to now which would allow the feeding of a material web to a cutting unit which is both fast and accurate.

OBJECTS OF THE PRESENT INVENTION

It is an object of the present invention to provide a method and apparatus which would make it possible to feed a sheet to a subsequent processing tool with accurate keeping in register without any part of either the feeding or the keeping in register having to be carried out after the processing tool as seen in the direction of movement of the material web.

It is a further object of the present invention to provide a method of feed which is quick, simple and exact and which is not subject to the disadvantages of known, similar feeding methods, e.g., sensitivity to changes in length of the material web.

It is a further object of the present invention to provide an arrangement which operates in accordance with a simple principle and uses simple mechanical components which, therefore, has high accuracy and operational safety.

It is a further object of the present invention to provide an arrangement wherein devices for first as well as for fine feeding are arranged as one unit.

SUMMARY OF THE INVENTION

These and other objects have been achieved in accordance with the invention in that the method of the type described in the introduction has been given the characteristic that the material web at each feeding step is advanced by means of friction engagement with a web feeding unit over a distance which substantially agrees with the desired feeding distance, whereupon the web feeding is interrupted and the correct register position for the following processing operation is imparted to the material web by means of a form-fitting engagement between the material web and the web feeding unit.

The invention also includes a web feeding unit which comprises two driving devices, namely on the one hand a driving surface for friction engagement with the material web, on the other hand two projections for form-fitting engagement with the material web, the two driving devices being adapted so as to be brought alternately into engagement with the material web for the periodical adjustment of the driving position of the material web in relation to a processing unit.

The method and the arrangement in accordance with the invention make possible an exact and rapid feeding of a material web to a subsequent processing device which, for example, may be a cutting device which divides the material web into individual sheets, since no part of either the feeding unit or the remaining devices which are required for keeping in register are situated after the processing unit. Owing to both driving devices, that is to say the driving device for the first feeding as well as for the register correction being designed as one unit, no extensions caused by external forces will affect the accuracy, so that the arrangement has great potentialities for making it operate quickly and with high accuracy.

A second preferred embodiment of the present invention includes a drive roller for feeding a continuous web along a web feed path and a registration roller downstream of the drive roller for adjusting the length of the continuous web fed along the web feed path so that the adjusted length equals the desired feed length and driving rollers downstream of the registration roller for removing each severed web portion from the web feed path. The drive roller is provided with a gap along its circumferential drive surface for temporarily interrupting the feeding of the continuous web by the drive roller and is further provided with a knife for transversely severing the continuous web during the aforementioned interruption. Such arrangement and the corresponding method is particularly suited to high speed operation because the web is extended beyond the drive roller no further than necessary so that the web is better adapted to endure high speed machine operations. The minimization of the feed length from the drive roller also makes the claimed arrangement more compact.

BRIEF DESCRIPTION OF THE DRAWING

Preferred embodiments of the method as well as of the arrangement in accordance with the invention will now be described in more detail with reference to the drawing, wherein:

FIG. 1 is a side view of a web feeding arrangement in accordance with a first preferred embodiment of the invention;

FIG. 2 is a perspective view of the driving unit of FIG. 1 with a material web passing through it in accordance with a preferred method of the present invention;

FIG. 3 is a perspective view of an alternate arrangement for the driving unit of FIG. 2;

FIG. 4 is a section through the driving unit of FIG. 2;

FIG. 5 is an end view of a portion of another alternate arrangement for the driving unit of FIG. 2;

DETAILED DESCRIPTION OF THE PREFERRED EMBODIMENTS

Figure 6:
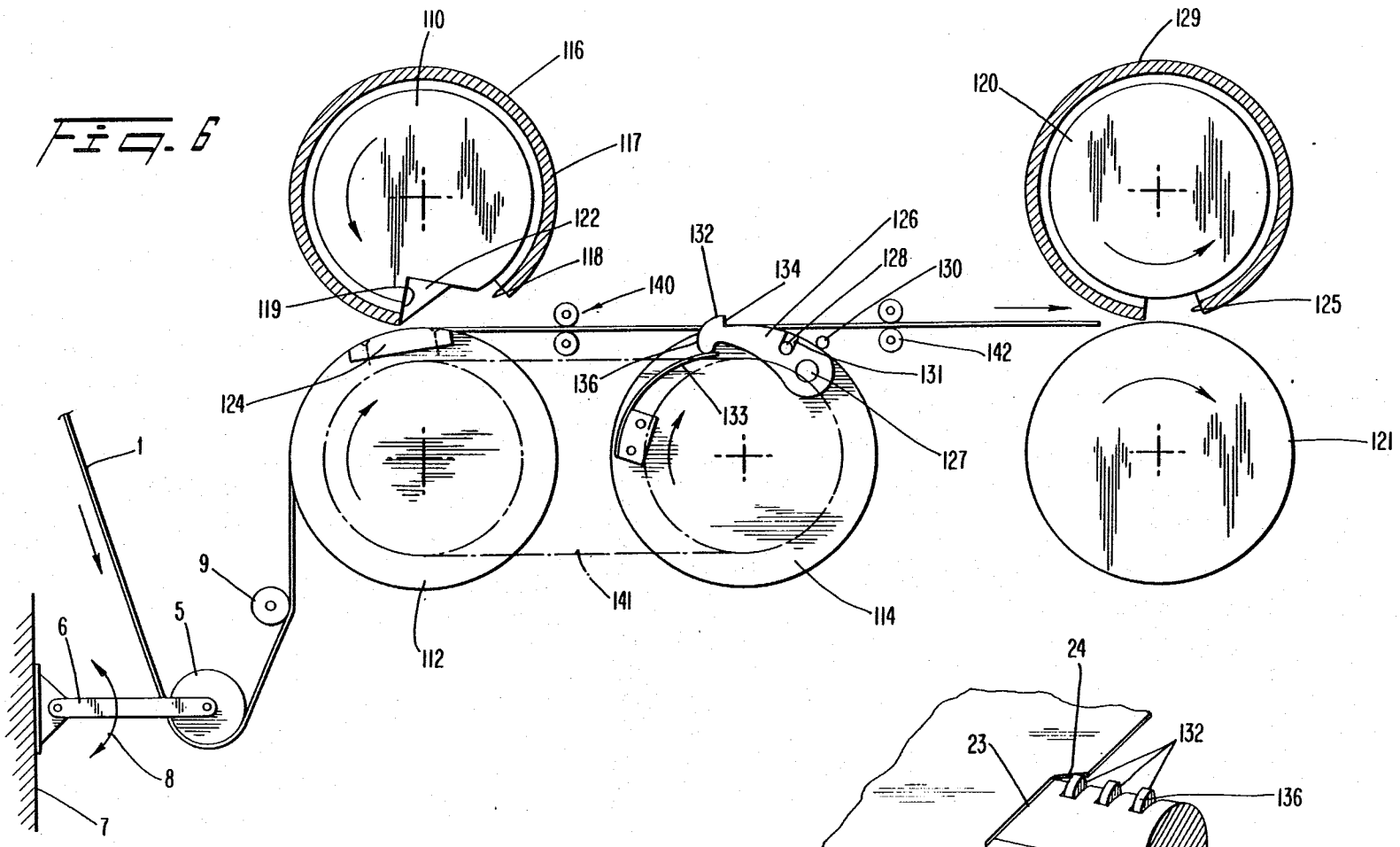
FIG. 6 is a side view of a web feeding arrangement according to another preferred embodiment of the present invention.

Referring to FIG. 1, a material web 1, which runs from left to right in the figure, is guided through a feeding unit 2 in accordance with a first preferred embodiment of the present invention to a processing unit 3 to be divided into individual sheets or blanks 4. The material web 1, for example, may be a web of packing laminate which comprises a central carrier layer of paper which is coated on either side with liquid-tight layers of thermoplastic material, for example, polyethylene. Such a packing laminate is used, for example, for the manufacture of non-returnable packages for milk, cream or juice. The laminate web is divided in the first place into individual sheets or packing container blanks, thereafter converted successively to individual packing containers which are filled with the desired contents and sealed. The conversion of the packing container blanks or sheets 4 to individual filled and sealed packing containers may be done according to known methods in packaging machines of known type and is not described, therefore, in any detail in the present text.

The material web 1 runs from a magazine roll (not shown) and a pair of driving rollers (also not shown), which feed the web from the magazine roll and forward to the arrangement in accordance with the invention. The web is conducted at this stage from the driving rollers and possibly via further elements, not shown, to a pendulum roller 5 which via lever arms 6 is supported pivotably in the machine frame 7. The pendulum roller 5 can swivel substantially upwards and downwards around the support of the lever arms 6 in the frame 7, which is indicated by the arrow 8. The swivelling movements of the pendulum roller 5 are made use of for the control of the rotation of the driving rollers (not shown) and hence the feeding of the web to the processing unit 3 in the rhythm as required. With the help of electric position detectors or the like the driving rollers are controlled so that the pendulum roller always moves between two defined limit positions. The momentary position of the pendulum roller thus varies continuously during operation of the arrangement and is connected not only with the web feeding induced by the driving rollers but also with the operation of the feeding unit 2 which will be explained in more detail in the following. The load on the material web exercised by the pendulum roller may be regulated to a value appropriate for the purpose through adjustment of the weight of the pendulum roller or through, e.g., spring loading of the pendulum roller.

After the material web 1 has passed the pendulum roller 5, it is guided via a freely rotatable guide roller 9 supported in the frame 7 to the feeding unit 2 in accordance with a preferred embodiment of the present invention. The feeding unit 2 comprises a feeding cylinder 10 and one or more compression roller 11 co-operating with the peripheral surface of the same. The feeding cylinder 10 is supported so that it can rotate in the frame 7 of the machine while the compression rollers 11 are supported on an axle 12 (FIG. 2, FIG. 5) which in turn is supported so that it can move vertically in the frame 7 of the arrangement at some distance above the axis of rotation of the cylinder 10. The compression rollers 11 are acted upon by a spring device 13 which may be a mechanically operating spring or some pneumatic or hydraulic piston and cylinder unit so as to lie against the peripheral surface of the cylinder 10.

As is evident more clearly from FIG. 2, the cylinder 10 comprises two driving devices, namely on the one hand a driving surface 14 for friction engagement with the material web 1, on the other hand projections 15 for form-fitting engagement with the peripheral edges of the material web. The projections 15 are located opposite one another on flanges 16 which are situated on both sides of the driving surface 14 and delimit the same in lateral direction. Each flange 16 has two projections 15 situated diametrically opposite each other. Above the cylinder 10, the driving unit, as previously mentioned, has two compression rollers 11 indicated by dash-dotted lines and the freely rotatable axle 12 of the same which is supported so that it is vertically movable.

After the material web 1 has passed the driving unit 2 in accordance with the invention, it approaches the processing unit 3 (FIG. 1) which comprises two cutting rollers 17, 18 which are rotatable in opposite directions. One of the cutting rollers 17, 18 is provided with cutting elements 19 in the form of knives situated diametrically opposite each other and extending parallel with the center axes of the cutting rollers. The other cutting roller also has diametrically oppositely situated cutting elements 19 in the form of hold-up tools which have a plane working surface with a wearing coat of, for example, plastic. The cutting elements 19 of the two cutting rollers 17, 18 cooperate with each other so that on synchronous rotation of the cutting rollers they cut off the material web 1 in transverse cuts and divide the same into individual sheets. The two cutting rollers 17, 18 are driven synchronously with one another and with the cylinder 10 by the previously mentioned driving motor.

The material divided up into individual sheets or packing container blanks 4 is then conducted via one or more guide rollers 9 situated after the processing unit 3 into the gap between two driving rollers 20, 21 which during operation of the arrangement rotate at a higher speed than the cutting rollers 18. The sheet 4 will thus be removed from the processing unit 3 at an accelerated rate thus preventing the separated sheet 4 from making contact with the front edge of the subsequent material web 1 and disturbing or hindering the course of cutting in the processing unit 3. The driving rollers 20, 21 feed the individual sheets to a collecting hopper or conveyor (not shown), whereafter the sheets are conveyed manually or automatically to the packaging machine for the conversion to individual packing containers.

During the feeding of the material web 1 through the arrangement in accordance with the invention it is ensured that the material web is divided into individual sheets or blanks 4 in register with the pattern of the material web. As is evident from FIG. 2, the material web 1 which is to be processed is provided with transverse crease lines 22 and with recesses 23 situated at the two longitudinal edges of the material web 1. The recesses 23 impart irregular edges to the material web which are used in accordance with the invention for keeping the material web in register during the feeding and processing in the processing unit 3. Naturally it is possible in other types of material webs to make use of different irregularities, e.g., cuts or emptying openings for the keeping in register. To this end, an adaptation of the elements 15 of the driving cylinder 10 engaging with the material web is required.

When the arrangement is in operation the material web 1 is fed with the help of friction engagement between the material web and the driving surface 14 of the cylinder 10. The engagement is ensured by means of the compression rollers 11 which by means of the spring element 13 are urged to lie against the material web 1 and press the same against the driving surface 14 so that the advance can take place without any slipping between the web and the driving surface 14, that is to say the web will be advanced at a speed which fully corresponds to the peripheral speed of the driving surface 14. The circumference of the driving surface 14 is approximately 1% greater than the desired length of one or more material sheets 4 and in the embodiment shown, the circumferential length of the driving surface corresponds to the length of two material sheets plus a further 1% to cover any deviations from the correct distance which may exist between the recesses 23 in the material web used for the keeping in register. The driving cylinder 10 rotates at a constant peripheral speed which corresponds to the speed of the cutting rollers 17, 18. Owing to the one-percent over-dimension of the cylinder circumference, the material web is normally advanced a little too far at each feed. This overfeeding is intended to be slightly greater than the maximum deviation in the distance between successive recesses 23 permissible according to the tolerance requirements on the material web. These deviations have to be corrected continuously so that they do not mount up to an accumulated effect which would seriously upset the accuracy of the processing unit. This is ensured in accordance with the invention in that at each feeding step the material web 1 is advanced first, as mentioned earlier, by the frictional engagement with the driving surface 14, over a distance which by and large corresponds to (and according to the preferred embodiment slightly exceeds) the desired feeding distance, whereupon the web feed is interrupted and the material web 1 is brought into the correct register position for the subsequent processing operation by form-fitting engagement between the material web 1 and the web feeding unit. More particularly, the web feeding is interrupted after each drive by means of the driving surface 14 in that the contact pressure of the web against the driving surface 14 is reduced, which means that the material web 1 can slip in relation to the driving surface 14. The slipping is induced by the pendulum roller 5 which drops and thereby lengthens the distance which the material web 1 must move from the feed cylinders (not shown), driving at continuous speed to the feeding unit 2. At this the portion of the web which passes the feeding unit 2 is retarded until the projections 15 have effected contact with the front edge 24 of the cooperating recesses 23. When this has occurred and the material web 1 is thus in a fixed, form-fitting engagement with the cylinder 10, the friction engagement between the web and the driving surface 14 is reestablished with the help of the compression rollers 11, whereupon the cutting off of the material web can take place in the correct register position in relation to the recesses 23, since the cutting rollers 17, 18 rotate synchronously with the cylinder 10. To make possible the slipping between the material web and the cylinder until the projections 15 have effected contact with the front edge 24 of the recesses 23 it is essential that the projections 15 should be narrower than the recesses, that is to say, the extension of the projections 15 in longitudinal direction of the driving surface 14 in general should be less than the length of the geometrical irregularities 23 in the material web with which the projections are adapted to engage.

In continuous operation of the feed unit in accordance with the invention the procedure described is repeated for each processing, that is to say, before each cutting off of a sheet or packing container blank 4 from the web. In the preferred embodiment the cylinder 10 is provided with two projections 15 located diametrically opposite each other and the driving surface 14 should thus have a total circumference which exceeds the length of two blanks 4 by a dimension which is equal to or slightly greater (approximately 1%) than the maximum plus tolerance which is permitted in the repeat or register length, that is to say, the distance between two successive recesses 23 on the material web. In the case of a sheet length of approximately 300 mm, a typical overdimension of 3 mm is chosen which means that after the feeding of a sheet (rotation of half a turn) the cylinder 10 has advanced the material web 2–3 mm too much. The front edge 24 of the recesses 23 is thus slightly in front of the corresponding front surface of the projections 15 which, as mentioned earlier, is corrected prior to the cutting off in that the friction engagement between the web and the cylinder is lifted and the web is retarded with the help of the pendulum roller until the form-fitting engagement between the projections and the recesses has been established again. Owing to the alternate activation of the two driving devices 14, 15, a periodical adjustment of the driving position of the material web in relation to the processing unit is ensured, as a result of which any accumulation of length errors is fully prevented and the keeping in register is assured during continuous operation of an indefinite time.

The first feeding of the web, which takes place during the time when the web is in frictional engagement with the driving surface 14 on the cylinder 10, is an overfeeding in the embodiment described, that is to say, the feeding distance is greater than the correct repeat length for the material and the correction feeding retarded or drew back the web until the form-fitting engagement with the projection 15 was obtained and the web was thus in the correct position. Naturally the opposite is also conceivable, that is to say, the web can be advanced in the first instance over slightly too short a distance, whereafter correction is made by momentarily increasing the speed of the web, so that the form-fitting engagement and consequently the correct register position is obtained. However, this solution seems to be more complicated and space demanding, since it would require a further pair of feed rollers between the feeding unit 2 and the processing unit 3. The method of operation, though, on principle will be similar.

The release of the friction engagement between the continuously rotating cylinder 10 and the material web is brought about in accordance with a preferred embodiment of the invention shown in FIG. 4 in that the substantially cylindrical driving surface 14 of the cylinder 10 is provided with two bevelled substantially plane areas 25. By limiting the path of movement of the compression rollers 11 with the help of the spring element 13 or in some other manner, contact between the cylinder 10 and the compression rollers is prevented when the cylinder assumes a position where any one of these bevelled surfaces 25 faces towards the compression rollers. At this point, the material web can slip in relation to the cylinder so that the form-fitting engagement between the projections and the material web is achieved. When this has taken place the cylinder 10 has rotated further through such an angle that the cylindrical portion of the driving surface 14 once again is situated straight under the compression rollers 11, as a result of which they will once more clamp the web against the driving surface 14 so that the friction engagement can take over the feeding of the web and the edges 24 are disengaged. The contact between the edges 24 and the lips 15 thus exists only for a short time and this helps prevent any deformation of the material web at the recesses 23.

The frictional engagement between the material web 1 and the driving surface 14 of the cylinder 10 can also be interrupted in a different manner, e.g., as shown in FIG. 5, in that the compression rollers 11 are periodically lifted from their position against the cylinder 10. To this end, the alternate arrangement shown in FIG. 5 comprises a cam 26 fixed to the cylinder 10 which cooperates with and acts upon a cam follower pulley 27 arranged on the axle 12 of the compression rollers 11. Owing to this arrangement, which can be doubled and be present on both ends of the driving cylinder 10, the axle 12 of the compression rollers 11 will be lifted periodically from its position against the compression roller 10 so that the pressure against the material web is eased and the latter can slip in relation to the driving surface 14, which in this arrangement may be wholly cylindrical and thus lack the planar, bevelled areas 25. The cam 26 may be designed as a simple cylindrical roll the periphery of which is provided with lips 28 at the points where lifting of the compression rollers 11 is desirable, that is to say, essentially 90° before the projection 15 of the cylinder 10. This placement, which also corresponds to the placement of the bevelled surfaces 25 in the arrangement according to FIG. 4, means that the compression rollers 11, on rotation of the cylinder 10 will disengage the material web 1 directly after the projections 15 have entered into the corresponding recesses 23 in the material web, which provides maximum time for register correction before, owing to the rotation of the cylinder 10 and the advance of the web, the projections 15 again leave the recesses 23.

When the feed unit in accordance with the invention is to be used for material webs of different widths, the cylinder 10 has to be substituted or adapted in some other manner to a different web width, e.g., by adapting the flanges 16 so that they can be shifted and fixed at various distances from one another on the cylinder 10. Referring to FIG. 3, another arrangement of the drive cylinder, like the other arrangements, requires a driving surface 14 and flanges 16, only one of which is visible. This flange 16, however, lacks projections 15 and the cylinder is provided instead with a number of pegs 29 which are placed in radial holes in the driving surface 14. The pegs 29 are spring-loaded in a direction outward from the center axis of the cylinder by compression springs 30 of such a strength that a material web 1 lying against the pegs 29 is able to press the pegs fully down into the surface 14 of the cylinder. On the periphery of the material web 1, however, the pegs 29 are able to remain in a projecting position so that they can engage in recesses in the longitudinal edges of the material web and thus fulfill the same function as the projections 15. This design makes possible a wholly automatic adaptation of the cylinder 10 to material webs 1 of different width and can be combined with the different realizations of the driving surface 14 of the cylinder and the maneuvering of the compression rollers 11 as described earlier. The peg-like projections can also be used advantageously when a material web is to be processed in register with holes (e.g., emptying openings) provided in the material web, in which case of course the projections must present a smaller extension seen in the direction of the web than the extension of the corresponding holes.

Figure 7:
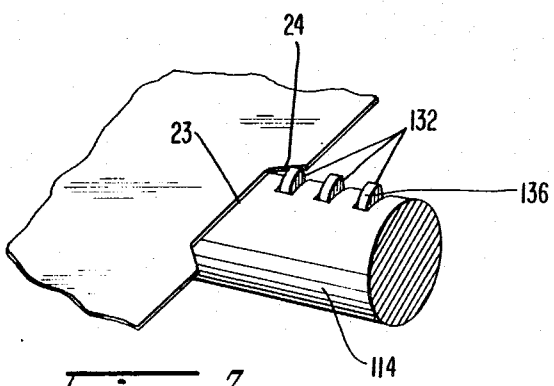
FIG. 7 is a perspective view of the register roller of the preferred embodiment of FIG. 6.

Referring to FIGS. 6 and 7, another preferred embodiment of the present invention provides a feeding unit 102 comprising a drive cylinder 110, a counter roller 112 in opposing relationship with the drive cylinder, a register roller 114 at a location downstream of the drive roller 110 and high-speed driving rollers 120 and 121, which are located downstream of the register roller 114. The feeding unit 102 also includes a pendulum roller 5 and a guide roller 9 upstream of the drive roller 110. As in the first preferred embodiment, the pendulum roller 5 is pivotally connected to the frame 7 by lever arms 6 and applies tension to the material web 1. Preferably, the guide roller 9 is positioned relative to the drive and counter rollers 110 and 112 so the continuous web 1 is directed partially about the circumference of the counter roller 112.

The drive roller 110 includes a layer of rubber 116 which extends partially around the drive roller 110 so as to provide a drive surface 117 having circumferential gap 118. The rubber layer 116 is adapted to frictionally engage the web 1 so as to feed the material web 1 forward to the right in FIG. 6. As the gap 118 moves over the counter roller 112, frictional engagement between the drive roller 110 and the material web 1 is relieved so that the pendulum roller 5 may act to retard and/or retract the material web 1.

The drive roller 110 also carries a knife 122 adjacent the trailing end 119 of the circumferential gap 118 such that when the knife 122 is rotated into opposing relation with a backup element 124 of the counter roller 112, the knife transversely severs the material web 1 across its entire width. The drive roller 110 may also be provided with flanges 16 but preferably without the projections 15 as in the arrangement of FIG. 3.

Although the layer 116 of the drive cylinder 110 is described as comprising rubber, other materials would be equally suitable for achieving frictional engagement with the material web 1 as would be readily apparent to one of ordinary skill in the pertinent art.

The register roller 114 carries a plurality of pivot arms 126 which are arranged along the length of the register roller 114 in side-by-side or longitudinally spaced relation to each other. Each pivot arm 126 is pivotally connected to the register roller by a longitudinal pin 127. A stop pin 128 affixed to the register roller 114 cooperates with a slot 131 in each pivot arm 126 to guide and limit the pivotal motion of each pivot arm 126. A spring 133 affixed to the register roller 114 biases each pivot arm 126 to a position against the stop pin 130. At that position, a longitudinal edge portion 130 of each pivot arm 126 conforms with the circumferential contour of the register roller 114 and a hooked end portion 132 protrudes radially beyond the register roller 114.

The side-by-side relationship of pivot arms 126 enables the register roller 114 to accommodate webs of different widths in a manner similar to the spring loaded pins 29 in the arrangement of FIG. 3. During feeding operations, those pivot arms 126 which are caused to lie beneath the material web 1 are pressed down by the web into the confines of the register roller 114, whereas those pivot arms 126 which lie beside the material web 1 are urged by the bias spring 133 to extend radially outwardly, with those which are closest to the material web 1 engaging an edge 24 of one of the web recesses 23. Each hooked end portion 132 includes a notch 134 which promotes steady engagement between the register roller 114 and the material web 1. Each hooked end portion preferably includes a rounded backside edge portion 136 which is adapted to minimize damage to the underside of the material web 1 whenever the web is caused to pass over one of the hooked end portions 132.

Rotation of the register roller 114 is synchronized with that of the counter roller 112 by a drive belt 141 or other suitable arrangement known to those skilled in the pertinent art. Another appropriate drive connection such as a second drive belt also drives the counter roller 112 and the drive roller 110 synchronously.

In this preferred embodiment, the circumference of the register roller 114 corresponds with the desired feed-length of the material web 1 so that upon each rotation of the register roller, the notch 134 passes through a registration position at top-dead-center over the registration roller. In reaching its registration position, the notch 134 adjusts the length of continuous web which extends beyond the drive control 110 to equal the desired length of the individual packaging blanks. The drive roller 110 and the counter roller 112 are synchronized with register roller 114 so that the notch 134 reaches its registration position as the knife 122 moves into an opposing relationship with the backup element 124 on the counter roller 112. Accordingly, just as the material web 1 is registered, the knife 122 severs the material web 1. It is to be appreciated that positions other than top-dead-center may be selected as the registration position for the notch 134.

The counter roller 112 has a slightly oversized circumference relative to the desired feed-length and is therefore larger in diameter than the register roller 114. By such arrangement, the material web 1 is advanced by the counter roller 112 relative to the register roller 114 so that during each cycle one of the hooked end portions 132 of the pivot arms enters a recess 123 with clearance from the edges 24. Consequently, during each cycle, the hooked end portion 132 of one of the pivot arms is brought forward into engagement with an edge 24 of the material web.

The drive roller 110 preferably has a circumference equal to that of the counter roller 112 so that the knife unit always meets with the backup element 124 of the counter roller 112 during each cycle.

The driving rollers 120 and 121 correspond with the two driving rollers 20 and 21 of the first embodiment and are adapted to quickly withdraw the severed portion of the web from the feed path of the drive roller 110. For this purpose, the driving rollers 120 and 121 rotate at a much higher speed than the drive roller 110. Preferably, at least one of the driving rollers 120 includes an outer rubber layer 129 for enhancing frictional engagement with the severed portion of material web 1. If desired, a gap 125 may be provided in the rubber layer 129 and the driving rollers 120 and 121 may be synchronized with the other rollers so as to prevent the driving rollers 120 and 121 from prematurely engaging the material web 1.

Located between the aforementioned sets of rollers are guides 140 and 142 whose arrangement and specific construction are matters known to those of ordinary skill in the pertinent art. These guides are placed along the web path between the register roller 114 and the other two pairs of rollers so as to facilitate smooth feeding of the material web 1.

In operation, the drive roller 110 feeds a length of material web 1 which generally approximates the desired length of the individual packaging blanks, at which time the circumferential gap 118 in the rubber layer 116 interrupts the driving engagement of the drive roller 110. During the interruption, the tension roller 5 acts to retard the feeding of the material 1 so as to allow the hooked pivot arm 126 of the register roller 114 to catch up with and move into engagement with an edge 24 along one of the borders of the material web. Preferably the same event takes place on the opposite side of the material web so that the web is driven evenly on both sides by at least a pair of pivot arms 126. Thereupon, the pivot arms 126 temporarily take over the forward feeding of the material web 1. As the register roller 114 rotates the notch 134 into its registration position, the desired feed length is exactly achieved and the knife 122 on the drive roller at that time severs the web so as to form the packaging blank according to the predetermined desired length. The hooked end portion 132 then feeds the severed web portion into the nip between the drive rollers 120 and 121 so that the severed web portion is quickly removed from the feed path of the driving roller 110. At this stage, the next cycle has started with the feeding of the remaining portion of the continuous web by the drive roller 110 toward the register roller 114.

In the preferred embodiment, the circumference of counter roller 110 is about 44 mm greater than the desired length of the packaging blanks, and the circumferential gap 118 in the rubber layer 116 is approximately 54 mm, so that the hooked end portion 132 of the register roller has to push the material web 1 forward by about 10 mm during each feed cycle.

The drive and register rollers 112 and 114 could be modified to carry more than one knife 122 and pivot arm 126, respectively, so that more than one feeding operation may be performed upon each rotation of the rollers. Because the feeding unit 102 severs the material web 1 at the drive roller 110, it does not leave a remnant of web material downstream of drive roller between feeding operations. Accordingly, the length of material extended along the web feed path during feeding operation is minimized, which situation facilitates high speed manipulation of the web and reduces the risk of buckling and tearing of the web. With the minimized feed length, the feeding unit 102 is more compact and accordingly saves valuable floor space at manufacturing facilities or the like.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. Apparatus for severing packaging blanks from a continuous web having recesses at uniform intervals along longitudinal edge portions of the continuous web, said apparatus comprising:

a drive roller and a counter roller rotatable in cooperation with each other and positioned at a first location along a web feed path, said drive roller having a circumferential surface adaped to frictionally engage the continuous web, whereby a length of the continuous web may be fed from the drive roller along said web feed path, one of said drive roller and said counter roller having a circumferential gap whereby the frictional engagement between the drive roller and the continuous web may be periodically interrupted;

means for transversely severing the continuous web, said severing means being located on one of said drive roller and said counter roller along said circumferential gap;

a registration roller at a location along said feed path downstream of said drive roller and said counter roller, said registration roller provided with a radial projection adapted to temporarily engage an edge of the web recesses, said registation roller rotating said radial projection into a predetermined registration position, whereby the length of the continuous web fed along said web feed path may be adjusted to a predetermined length;

means for synchronously rotating the one of said drive roller and said counter roller in which the circumferential gap is provided with said registration roller so that said radial projection of the registration roller is adapted to temporarily engage the continuous web during said periodic interruption of the frictional engagement of the drive roller and the transverse severance of the web occurs concurrently with the rotation of the radial projection into said predetermined registration position; and means for removing a severed web portion from the web feed path.

2. The apparatus as claimed in claim 1, further comprising means for applying tension to said continuous web at a location upstream of said drive roller.

3. The apparatus as claimed in claim 2, further comprising means for guiding the web about a circumferential portion of said counter roller, said registration roller having a circumference corresponding in length to said predetermined length, said counter roller having a circumference greater than that of said registration roller.

4. The apparatus as claimed in claim 3, wherein said removing means includes driving rollers at a location downstream of said registration roller, said radial projection adapted to urge the severed web portion into engagement with said driving rollers, said driving rollers rotating at a speed greater than said drive roller.

5. The apparatus as claimed in claim 3, wherein said severing means includes a knife located adjacent a trailing end region of said circumferential gap.

6. The apparatus as claimed in claim 3, wherein the circumferential gap has a length greater than the difference in circumference between the counter roller and the registration roller.

7. The apparatus as claimed in claim 3, wherein said circumferential surface is formed by a layer of rubber-like material.

8. The apparatus as claimed in claim 3, wherein said radial projection is a hooked end portion of an arm pivotally connected with said register roller, said registration roller provided with biasing means for urging said hooked end portion radially outwardly and means for limiting the pivoting of said arm.

9. The apparatus as claimed in claim 8, wherein said registration roller is provided with a plurality of pivot arms disposed along a longitudinal side of said registration roller, whereby said registration roller may accommodate webs of different widths.

10. A method of severing packaging blanks of a predetermined length from a continuous web having recesses at uniform intervals along longitudinal edge portions of the continuous web, said method comprising the steps of:

continuously rotating a drive roller and a register roller;

feeding the continuous web along a feed path beyond said drive roller toward said register roller by frictionally engaging the continuous web with a circumferential surface of the drive roller;

adjusting the length of the continuous web fed beyond the drive roller by temporarily relieving the frictional engagement between the continuous web and the drive roller with a circumferential gap in said circumferential surface of the drive roller and concurrently feeding the continuous web with the register roller by temporarily engaging a radial projection of said register roller with an edge of the web recesses;

as said temporarily engaged radial projection rotates with said register roller into a predetermined registration position, transversely severing the continuous web with severing means which is affixed to said drive roller;

removing a severed web portion from said feed path.

11. The method as claimed in claim 10, further comprising the step of applying tension to the continuous web at a location preceding said drive roller.

12. The method as claimed in claim 11, wherein said severing means is affixed to said drive roller at a location along said circumferential gap and drive roller cooperates with a counter roller having a circumference greater than said register roller.

13. The method as claimed in claim 12, wherein said step of removing a severed web portion includes the steps of rotating driving rollers at a location along said web path downstream of said register roller at a rotational speed greater than that of said drive roller and urging the severed web portion into a nip between said downstream driving rollers with said radial projection of the register roller.

* * * * *